US008117853B2

(12) United States Patent
Schmid

(10) Patent No.: US 8,117,853 B2
(45) Date of Patent: Feb. 21, 2012

(54) METHOD OF OPERATING A REFRIGERATOR UNIT AND/OR FREEZER UNIT AS WELL AS A REFRIGERATOR UNIT AND/OR FREEZER UNIT OPERATED USING SUCH A METHOD

(75) Inventor: Eugen Schmid, Biberach-Mettenberg (DE)

(73) Assignee: Liebherr-Hausgeraete Ochsenhausen GmbH, Ochsenhausen (DE)

( * ) Notice: Subject to any disclaimer, the term of this patent is extended or adjusted under 35 U.S.C. 154(b) by 591 days.

(21) Appl. No.: 12/363,226

(22) Filed: Jan. 30, 2009

(65) Prior Publication Data

US 2009/0188262 A1 Jul. 30, 2009

(30) Foreign Application Priority Data

Jan. 30, 2008 (DE) ..... 10 2008 006 760
Apr. 2, 2008 (DE) ..... 10 2008 016 926

(51) Int. Cl.
*F25D 3/12* (2006.01)

(52) U.S. Cl. ..... 62/56; 62/441

(58) Field of Classification Search ..... 62/56, 126, 62/129, 158, 208, 211, 441
See application file for complete search history.

(56) References Cited

U.S. PATENT DOCUMENTS 5,355,686 A * 10/1994 Weiss ..... 62/89
5,778,694 A * 7/1998 Jeong ..... 62/187
6,055,820 A * 5/2000 Jeong et al. ..... 62/186
7,891,198 B2 * 2/2011 Wetekamp et al. ..... 62/66
2003/0029178 A1 * 2/2003 Zentner et al. ..... 62/186
2003/0182962 A1 * 10/2003 Shim et al. ..... 62/440
2005/0016202 A1 * 1/2005 Ko et al. ..... 62/441
2005/0115268 A1 * 6/2005 Hallin et al. ..... 62/407
2005/0120727 A1 * 6/2005 Flinner et al. ..... 62/126
2007/0039339 A1 * 2/2007 Lee ..... 62/183
2007/0163286 A1 * 7/2007 Lim et al. ..... 62/389
2007/0193280 A1 * 8/2007 Tuskiewicz et al. ..... 62/3.6
2008/0022694 A1 * 1/2008 Anderson et al. ..... 62/3.4

FOREIGN PATENT DOCUMENTS

EP 1 524 482 4/2005

OTHER PUBLICATIONS

ISA Germany; International Search Report of DE10 2008 016 926.9; Apr. 2, 2008; Germany.

* cited by examiner

*Primary Examiner* — Mohammad Ali
(74) *Attorney, Agent, or Firm* — Alleman Hall McCoy Russell & Tuttle LLP

(57) ABSTRACT

The present disclosure relates to a method for the operation of a refrigerator unit and/or a freezer unit having two compartments or more than two compartments which each have at least one opening which is closable by a closure element and through which the compartments can be charged with cold air, with at least one temperature sensor being provided for the indirect or direct detection of the respective actual temperature value, wherein a temperature value (closing value) is defined for a plurality of the compartments or for all of the compartments, wherein the compartment with the lowest difference between the actual temperature value and the closing value (temperature difference) is determined, and wherein the closure element of this compartment is closed until its temperature difference is the same as or larger than the temperature difference of a compartment having a larger temperature difference, preferably having the next larger temperature difference.

17 Claims, 2 Drawing Sheets

METHOD OF OPERATING A REFRIGERATOR UNIT AND/OR FREEZER UNIT AS WELL AS A REFRIGERATOR UNIT AND/OR FREEZER UNIT OPERATED USING SUCH A METHOD

CROSS REFERENCE TO RELATED APPLICATIONS

This application claims priority to German Patent Application No. 10 2008 006 760.1, filed Jan. 30, 2008, and German Patent Application No. 10 2008 016 926.9 filed Apr. 2, 2008, both of which are hereby incorporated by reference in their entirety for all purposes.

BACKGROUND AND SUMMARY

The present disclosure relates to a method of operating a refrigerator unit and/or a freezer unit having two compartments or more than two compartments which each have at least one opening which is closable by a closure element and through which the compartments can be charged with cold air, with at least one temperature sensor being provided for the indirect or direct detection of the respective actual temperature value.

Refrigerator units and/or freezer units are known from the prior art which have a plurality of compartments, with the supply of refrigerated air to the compartments and the air return of heated air from the compartments being controlled by means of air flaps. In this connection, units are known in which an air flap is associated with each compartment with a different temperature. It is furthermore known from the prior art to provide units in which compartments are provided without any lower temperature limitation, for example, freezer parts which are also cooled on the refrigeration demand of another compartment.

It is the underlying object of the present disclosure to further develop a method of the initially named kind such that the setting of the temperatures in the compartments takes place in a particularly energy efficient manner.

This object is solved in accordance with the disclosure by a method for the operation of a refrigerator unit and/or a freezer unit having two compartments or more than two compartments which each have at least one opening which is closable by a closure element and through which the compartments can be charged with cold air, with at least one temperature sensor being provided for the indirect or direct detection of the respective actual temperature value of the compartments.

Provision is made in accordance with this that a temperature value (closing value) is defined for a plurality of the compartments or for all of the compartments, that the compartment with the lowest difference between the actual temperature value and the closing value (temperature difference) is determined, and that the closure element of this compartment is closed until its temperature difference is the same as or larger than the temperature difference of a compartment having a larger temperature difference, in one example the compartment having the next larger temperature difference. It is, for example, feasible that, at a specific temperature value above the closing value, the temperature differences of the compartments with an opened closure element are compared with one another and that the closure element of the compartment is thereupon closed in which the lowest temperature difference is present, that is, the smallest interval between the actual temperature value and the closing value. Due to the fact that the closure element of this already comparatively cold compartment is already closed, the total cold air is now supplied to the remaining compartments with an open closure element, which has the result that these undergo a relatively fast cooling and the comparatively cold compartment does not become too cold. The closure element of the named compartment is closed for so long until it is found that its temperature difference is the same as or larger than that of another compartment. Provision is preferably made that the respective compartment with the originally lowest temperature difference is opened by opening the closure element if its temperature difference is equal to or larger than the actual temperature difference value to the closing value of the compartment having the next larger temperature difference of actual value to closing value. The hysteresis can amount to 0.5 K, for example.

The present disclosure furthermore relates to a method of operating a refrigerator unit and/or a freezer unit having at least one evaporator as well as having two compartments or more than two compartments which each have at least one opening which is closable by a closure element and through which the compartments can be charged with cold air, with at least one temperature sensor being provided in the respective compartments for the indirect or direct detection of the actual value of the temperature, the method comprising. Provision is accordingly made that a temperature range (opening range) is defined for a plurality of compartments or for all of the compartments of the unit, that the evaporator is activated when the temperature in one of the compartments reaches or exceeds the upper value of the opening range and/or when the evaporator activation temperature is reached or exceeded. Provision is furthermore made that the closure element of this compartment as well as the closure elements of the further compartment or compartments are opened when their actual temperature values are within the respective opening range.

Provision is made in this case that the closure element of the compartment is opened when its temperature has reached or already exceeded the upper limit of the opening range. Furthermore, the closure elements of the compartments are opened whose actual temperature value is within the respective opening range.

The term "temperature sensor" is to be given a wide interpretation and includes any conceivable means suitable to draw conclusions on the temperature in the compartment. In one specific example, a respective one or a plurality of temperature sensors are provided in each or in some of the compartments. In another specific example, alternatively or additionally, a temperature sensor is provided which detects the evaporator temperature or a different temperature via which conclusions can be drawn on the temperatures in the compartments.

Provision is made in a further embodiment of the disclosure that the determination of the compartment having the lowest temperature difference and the closing of its closure element only takes place when the actual temperature value has reached or fallen below a predetermined interval to the closing value. It is conceivable to determine the differences between the actual temperature values and the respective closing values for all the compartments. If it is found that the interval of the actual temperature value from the closing value has reached or fallen below a specific interval, for example 4 K, for a compartment, provision can be made that the temperature differences, that is, the differences between the respective actual temperature values and the closing values, of the compartments having open closure elements are compared with one another. Then the closure element of the compartment with the lowest temperature difference is closed.

Provision is made in a preferred embodiment of the disclosure that the unit has at least one fan by means of which cold air can be introduced into the compartments through the named closable openings.

The unit can have at least one refrigerated air passage, with the fan being arranged such that it moves the air through the refrigerated air passage into the compartment or compartments. The refrigerated air passage can, for example, be bounded by a vertical partition plate which is located in the rear region of the unit and which can, for example, form the rear wall of the compartment or compartments.

Provision is made in a further embodiment of the disclosure that the fan is activated when the evaporator temperature reaches or falls below a limit value. It is, for example, conceivable that the fan is activated when the evaporator temperature is below the temperature of the compartment whose temperature has reached or exceeded the upper value of the opening range by a predetermined value, for example 1 K.

Provision is made in a further embodiment of the disclosure that the closure elements of the compartments are opened when their actual temperature value reaches or exceeds the lower region of the opening range. If compartments are accordingly present whose actual temperature values are below the lower limit of the opening range, their closure elements first remain closed. Provided the actual temperature values reach the lower region of the opening range, the associated closure elements are opened so that the compartments are charged with cold air.

Provision is made in a further embodiment of the disclosure that the evaporator is deactivated when the actual temperature values of all the compartments have reached their respective closing values.

If this is the case, provision can additionally be made that the speed of the fan is reduced with respect to the actual refrigeration operation.

Provision can furthermore be made that the closure elements of the compartments whose closure elements are opened at times or permanently during the cooling procedure are now opened when the actual temperature values of all the compartments have reached their respective closing values. In this case, cold air is introduced into the compartments at a reduced speed of the fan. In this manner the residual cold can be utilized and the standing time shortened. Provision can furthermore be made that the fan is finally deactivated when the evaporator temperature reaches or exceeds a limit value.

Provision can finally be made that the respective closure element is closed as soon as the respective actual temperature value or a value characteristic for the temperature reaches a desired value or exceeds it by a preset amount.

Provision is made in a further embodiment of the disclosure that a desired temperature value is presettable for at least one of the compartments and that the opening range and/or the closing value of the other compartments depend on the desired temperature value. If, for example, with an unchanged desired value setting of the compartment arranged at the top, the desired value setting of a compartment arranged thereunder is changed in the direction of "cold", the opening range and the closing value of the closure element of the upper compartment are corrected in the direction "warm" in order to compensate the increased cooling by the return air flow from the lower compartment.

The present disclosure furthermore relates to a refrigerator unit and/or a freezer unit having, comprising two or more compartments which each have at least one opening which is closable by a closure element and through which the compartments can be charged with cold air; at least one temperature sensor positioned in each of the two or more compartments, the temperature sensor providing indirect or direct detection of an actual temperature value of the respective compartments; and a control and/or regulation unit which is configured to determine a temperature value for each of the two or more compartments, determine a compartment with the lowest temperature difference between an actual temperature value and the determined temperature value; and close the closure element of this determined compartment until its temperature difference is the same as or larger than a temperature difference of another compartment having a larger temperature difference.

Further details and advantages of the disclosure will be explained in more detail with reference to an embodiment shown in the drawing.

DETAILED DESCRIPTION

Figure 1:
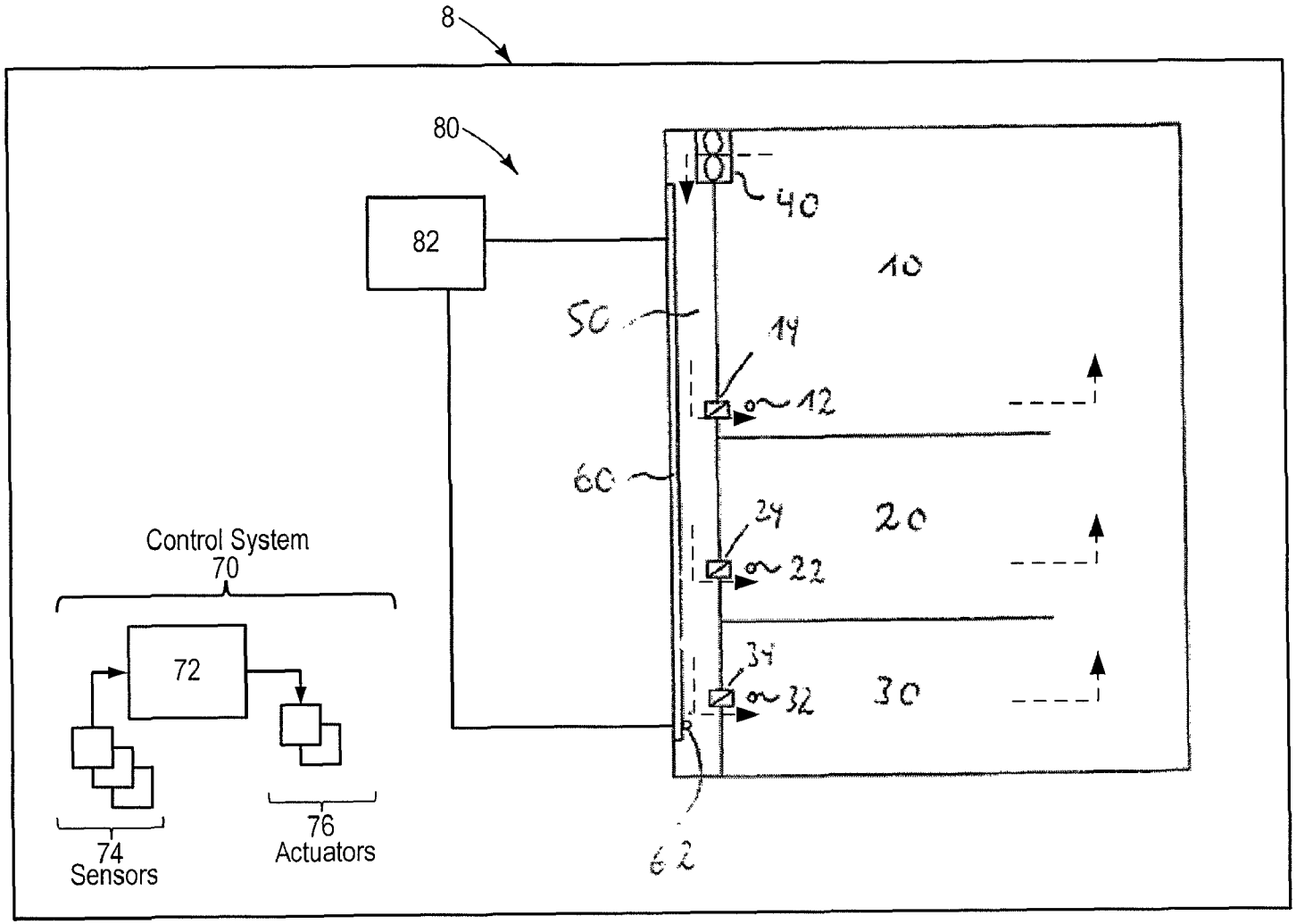
FIG. 1 shows a refrigerating unit in accordance with the present disclosure.

The refrigerating and/or freezing unit 8 in accordance with the embodiment shown here has a refrigerating part 10 arranged at the top as well as a compartment ("BioFresh, variable) arranged thereunder and a compartment 30 ("BioFresh, fixed) arranged thereunder. This arrangement is only by way of example. Other arrangements of the compartments are also conceivable. A fan is marked by the reference numeral 40 which extracts air from the compartment 10 and conveys it into the refrigeration air passage 50 as indicated by the dashed line arrows. The evaporator 60 with the evaporator sensor 62 is located therein. The evaporator sensor 62 emits a temperature value characteristic for the temperature of the evaporator 60. The unit 8 further includes a refrigeration circuit 80 having a compressor 82 coupled to the evaporator 60.

The refrigerating unit 8 may further include a control system 70. Control system 70 is shown receiving information from a plurality of sensors 74 (such as sensors 62, 12, 22, 32) and sending control signals to a plurality of actuators 76 (such as fan 40, closure elements 14, 24, 34, etc.). The control system 70 may include a control/regulation unit 72 (controller). The controller may receive the input data from the various sensors, process the input data according to various routines, and trigger the actuators in response to the processed input data based on instructions or code programmed therein corresponding to one or more routines or methods. Example control routines and methods are described herein (e.g., with regard to FIG. 2). In one example, the routines and/or methods are embodied in instructions and/or code on computer readable storage media included in the controller 72.

As can further be seen from FIG. 1, a temperature sensor 12, 22, 32 is located in each of the compartments.

Furthermore, each of the compartments 10, 20, 30 can be connected to the refrigeration air passage 50 via an air flap or any other closure element 14, 24, 34. When the air flap 14, 24, 34 is open, air is accordingly introduced from the refrigeration air passage 50 into the respective compartment 10, 20, 30. FIG. 1 shows an example airflow configuration via arrows in which the fan is operating and each of air flaps 14, 24, and 34 are open. As described herein, various other flap configurations may be used to adjust airflow differently among the compartments.

As can furthermore be seen from FIG. 1, the air which has flowed through the compartments 10, 20, 30, is led back through the actual useful capacity of the unit to the fan 40. In this way, a useful capacity loss is avoided by separately provided air passages for the returning of already heated air. The air return of all temperature zones or compartments rather takes place together in the useful capacity zone in accordance with the depicted example.

Figure 2:
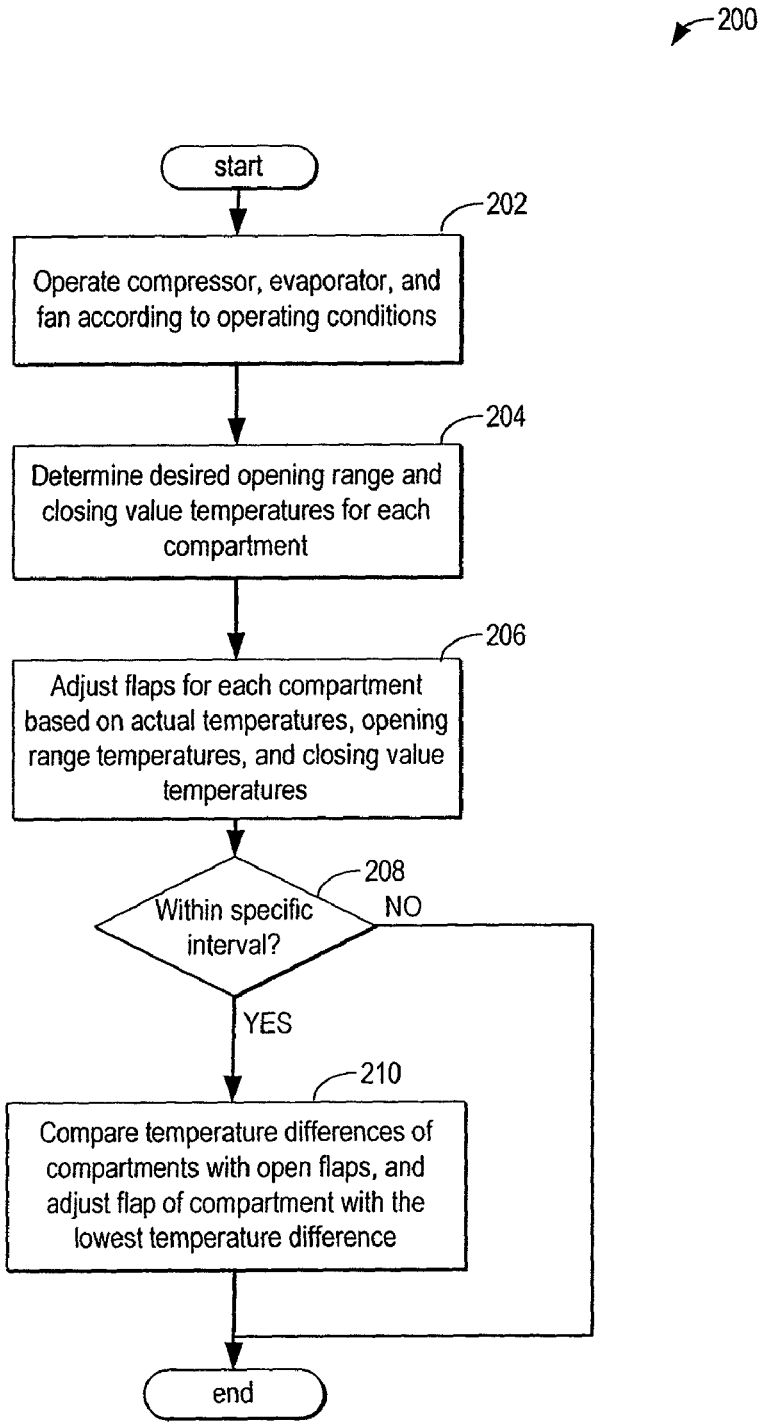
FIG. 2 shows an example method of operation.

FIG. 2 shows an example method 200 for controlling operation of the refrigerator unit. The refrigerator unit in accordance with the present disclosure has an evaporator and a fan and serves for the control or regulation of the temperatures in the individual compartments which takes place independently of one another.

To minimize the compressor running times, the times at which the air flaps 14, 24, 34 are open are synchronized in dependence on the respective cold demands.

Any temperature influence due to the air return through the useful capacity zone can be prevented by a corresponding control/regulation of the opening and closing times of the respective air flaps 14, 24, 34 associated with the individual temperature zones or compartments 10, 20, 30.

Provision is made in the embodiment shown here, e.g., via the control system, that the compartments 10, 20, 30 are each operated at a specific desired temperature value or in a desired temperature value range, with the desired values or the desired value ranges being able to differ from one another.

The control of the air flaps 14, 24, 34 takes place via a corresponding control member which is in turn connected to the control/regulation unit. As noted above, it receives temperature values from the temperature sensors 12, 22, 32.

An opening range and a closing value are defined for each of the compartments 10, 20, 30. The opening range should allow a proportion of parallel operation of the individual compartments which is as high as possible and thus an energy-saving operation.

The temperature control or temperature regulation is as follows:

At 202, the compressor, evaporator, and fan are operated according to operating conditions. For example, as soon as one of the three temperature sensors 12, 22, 32 exceeds the upper value of the opening range associated with the respective compartment and the evaporator sensor has reached its activation value, the evaporator 60 is activated, which in other words means that the refrigerant circuit, optionally with the compressor, magnetic valve, etc., is set into operation. If the evaporator sensor 62 reports a temperature value of, for example, 1 K below the temperature value of the compartment whose temperature has exceeded the opening range associated with the compartment, the fan 40 is switched on at a high speed and the corresponding air flap of the compartment is opened. If, for example, the temperature value in the compartment 10 has exceeded the upper limit of the opening range and if the evaporator sensor 62 has reached the activation value, the evaporator is activated. If the evaporator 60 is sufficiently cold, if the temperature measured with the temperature sensor 62 is, for example, 1 K below the temperature measured with the temperature sensor 12, the fan 40 is switched on and the air flap 14 is opened so that the compartment 10 is charged with cold air.

The same naturally applies accordingly to the other compartments, provided that their actual temperature values have exceeded the upper values of the respective opening ranges.

At 204, the method determines a desired opening temperature range and closing value temperature for each compartment.

At 206, the flaps are adjusted (e.g., opened, closed, or made more or less open/closed) based on the determined and actual temperatures. For example, if the temperature values of the other compartments are within the respective opening range, their associated air flaps (in the aforesaid example thus the air flaps 24 and 34) are also opened. If compartments are present whose actual temperature values are not (yet) in the respective opening range, their air flaps remain closed until the actual temperature value has reached the lower value of the associated opening range. The associated air flap is then opened.

It is conceivable in the embodiment shown here that all the closure elements or air flaps 14, 24, 34 are open during the refrigerating procedure so that all the compartments 10, 20, are supplied with cold air from the refrigeration air passage 50 through the openings, as shown in FIG. 1.

At 208, from a specific interval (e.g. 4 K) before the respective closing value, the temperature differences, that is, the differences from the actual temperature value to the closing value of the compartments 10, 20, 30 whose closure elements 14, 24, 34 are open are compared with one another. In this respect, the compartment with the lowest temperature difference from the actual temperature value and the closing value is determined and its closure element is closed. If, for example, the difference between the actual temperature value and the closing value in the compartment 30 is lower than in the compartments 10 and 20, the closure element 34 is closed at 210. The closure element remains closed for so long until the temperature difference of this compartment is equal to or larger than the temperature difference of the compartment with the next higher temperature difference. If, for example, at a specific time, the temperature difference between the actual temperature value and the closing value in the compartment 30 whose closure element 34 is closed is 5 K and if the compartment 20 has cooled so much that the temperature difference is likewise 5 K or less there, the closure element 34 of the compartment 30 is opened again.

Additional operations may also be provided in method 200, e.g., at 202. For example, if all the compartments 10, 20, 30 have reached their closing values, the evaporator 60 is deactivated by switching off the compressor or by connection of a magnetic valve, for instance, and the speed of the fan 40 is set to a lower value. If the air flaps 14, 24, 34 are closed, they are opened, provided that they were at least partly opened in the phase in which all the compartments have not yet reached their closing values, i.e. in the cooling phase.

If the evaporator 62 reports a specific temperature value, for example, 5° C., the fan 40 is completely switched off.

In one example, the flaps 14, 24, 34 are closed as soon as the corresponding temperature sensor 12, 22, 32 reports a temperature which corresponds to the desired temperature value of the respective compartment and optionally corresponds to a supplement of, for example, 3 K.

The evaporator remains deactivated until the evaporator sensor 62 has reached the activation value and/or an air sensor reaches an upper corridor value.

Further, the setting of the individual temperature zones influences the opening and closing values of the air flaps associated with the other temperature zones or compartments due to the parallel correction factors defined in steepness.

If, for example, with an unchanged desired value setting of the upper compartment 10, the desired value setting of the compartment 20 is changed downwardly, that is, in the direction of "cold", the opening and closing values or the opening range and the closing value of the upper compartment 10 are corrected in the direction of "warm" to compensate the increased cooling due to the return air flow from the lower compartment 20. The reverse naturally applies correspondingly when the desired value setting of a compartment is changed in the direction of "warm".

The invention claimed is:

1. A method for the operation of a refrigerator unit and/or a freezer unit having two compartments or more than two compartments which each have at least one opening which is closable by a closure element and through which the compartments can be charged with cold air, with at least one temperature sensor being provided for the indirect or direct detection of the respective actual temperature value of the compartments; the method comprising:

defining a temperature value for a plurality of the compartments or for all of the compartments;

determining a compartment with the lowest temperature difference between an actual temperature value and the defined temperature value; and closing the closure element of this determined compartment until its temperature difference is the same as or larger than a temperature difference of a compartment having a larger temperature difference.

2. The method of claim 1 wherein the temperature value defined for the plurality of the compartments or for all of the compartments is a closure element closing value, and wherein the compartment having the larger temperature difference than the lowest temperature difference include a compartment having a next larger temperature difference than the lowest temperature difference as compared to other compartments.

3. The method in accordance with claim 1, wherein the determination of the compartment having the lowest temperature difference and the closing of its closure element only takes place when the actual temperature value has reached or fallen below a predetermined interval.

4. The method in accordance with claim 1, wherein the unit has at least one fan positioned to introduce cold air into the compartments through the closable openings.

5. The method in accordance with claim 4, wherein a refrigeration air passage is provided, with the fan being arranged such that the air is moved into the compartment or compartments through the refrigeration air passage.

6. The method in accordance with claim 5, wherein the fan is activated when the evaporator temperature reaches or falls below a limit value.

7. The method in accordance with claim 5, wherein the fan is activated when the evaporator temperature is below the temperature of the compartment whose temperature has reached or exceeded the upper value of the opening range by a predetermined value.

8. The method in accordance with claim 1, wherein the closure elements of the compartments are opened when their actual temperature value reaches or exceeds a lower end of the opening range.

9. The method in accordance with claim 1, wherein the evaporator is deactivated when the actual temperature values of all compartments have reached their respective closing values.

10. The method in accordance with claim 4, wherein a speed of the fan is reduced when the actual temperature values of all compartments have reached their respective closing values.

11. The method in accordance with claim 1, wherein the closure elements of the compartments whose closure elements were opened at times or permanently during the cooling procedure are opened when the actual temperature values of all the compartments have reached their respective closing values.

12. The method in accordance with claim 4, wherein the fan is deactivated when the evaporator temperature reaches or exceeds a limit value.

13. The method in accordance with claim 1, wherein the respective closure element is closed as soon as the respective actual temperature value or a value characteristic for it has reached a desired value or has exceeded it by a preset amount.

14. The method in accordance with claim 1;

wherein a desired temperature value is presettable for at least one of the compartments; and wherein the opening range and/or the closing value of the other compartments depend on the desired temperature value.

15. A refrigerator unit and/or a freezer unit, comprising:

two or more compartments which each have at least one opening which is closable by a closure element and through which the compartments can be charged with cold air;

at least one temperature sensor positioned in each of the two or more compartments, the temperature sensor providing indirect or direct detection of an actual temperature value of the respective compartments; and a control and/or regulation unit which is configured to:

determine a temperature value for each of the two or more compartments;

determine a compartment with the lowest temperature difference between an actual temperature value and the determined temperature value; and close the closure element of this determined compartment until its temperature difference is the same as or larger than a temperature difference of another compartment having a larger temperature difference.

16. A method of operating a refrigerator unit and/or a freezer unit having at least one evaporator as well as having two compartments or more than two compartments which each have at least one opening which is closable by a closure element and through which the compartments can be charged with cold air, with at least one temperature sensor being provided in the respective compartments for the indirect or direct detection of the actual value of the temperature, the method comprising:

determining a temperature zone, the temperature zone defining an opening temperature range for a plurality of the compartments or for all of the compartments;

activating the evaporator when the actual temperature in one of the compartments reaches or exceeds an upper end of the opening temperature range and/or when an evaporator activation temperature has been reached or exceeded; and opening a closure element of the compartment that reaches or exceeds the upper end, as well as opening closure elements of a further compartment or compartments when their temperature values are within their respective opening ranges.

17. The method of claim 16 further comprising:

determining a closing temperature value for the plurality of the compartments or for all of the compartments;

determining a compartment with the lowest temperature difference between an actual temperature value and the determined closing temperature value; and closing the closure element of this determined compartment until its temperature difference is the same as or larger than a temperature difference of a compartment having a larger temperature difference.

* * * * *